US007179066B2

(12) United States Patent
Good et al.

(10) Patent No.: US 7,179,066 B2
(45) Date of Patent: Feb. 20, 2007

(54) ELECTRIC MOTOR FUEL PUMP

(75) Inventors: Julie K. Good, Gagetown, MI (US); Shane L. Kady, Marlette, MI (US); George E. Maroney, Kingston, MI (US); Bradley L. Uffelman, Caro, MI (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 594 days.

(21) Appl. No.: 10/639,938

(22) Filed: Aug. 13, 2003

(65) Prior Publication Data

US 2005/0053491 A1 Mar. 10, 2005

(51) Int. Cl.
*F04B 17/03* (2006.01)

(52) U.S. Cl. ..... 417/423.14

(58) Field of Classification Search ..... 417/423.1, 417/423.14

See application file for complete search history.

(56) References Cited

U.S. PATENT DOCUMENTS

| | | | | |
|---|---|---|---|---|
| 5,257,916 | A | 11/1993 | Tuckey | |
| 6,227,819 | B1 * | 5/2001 | Gettel et al. | 417/423.1 |
| 6,231,318 | B1 * | 5/2001 | Cotton et al. | 417/423.1 |
| 6,893,206 | B2 * | 5/2005 | Talaski | 415/55.6 |

* cited by examiner

*Primary Examiner*—Michael Koczo, Jr.
(74) *Attorney, Agent, or Firm*—Reising, Ethington, Barnes, Kisselle, P.C.

(57) ABSTRACT

A fuel pump has an electric motor with a stator, a rotor, a generally cylindrical tube having opposed ends, a fuel pumping element driven by the electric motor to take in fuel and discharge fuel under pressure, and a plate having a face disposed adjacent to the fuel pumping element and a discontinuous support surface against which one end of the tube is received. The discontinuous support surface preferably minimizes distortion of the plate face under loading from the tube in assembly of the fuel pump.

29 Claims, 3 Drawing Sheets

ELECTRIC MOTOR FUEL PUMP

FIELD OF THE INVENTION

This invention relates generally to fuel pumps, and more particularly to electric motor fuel pumps.

BACKGROUND OF THE INVENTION

Electric motor fuel pumps have been widely used to supply the fuel demand for an operating engine, such as in automotive applications. These pumps may be mounted directly within a fuel supply tank and have an inlet for drawing liquid fuel from the surrounding tank and an outlet for delivering fuel under pressure to the engine. The electric motor includes a rotor mounted for rotation within a stator in a housing and connected to a source of electrical power for driving the rotor about its axis of rotation. In so-called turbine or regenerative type fuel pumps, an impeller is coupled to the rotor for co-rotation with the rotor and has a circumferential array of vanes about the periphery of the impeller. One example of a turbine fuel pump of this type is illustrated in U.S. Pat. No. 5,257,916.

A typical turbine-type fuel pump has an impeller with opposed generally planar faces disposed between two plates each having a generally planar face adjacent to the impeller. The clearance between the adjacent faces of the impeller and plates is usually made small to, among other things, reduce leakage. However, reducing the clearance between the plates and the impeller can unduly increase the friction between them and thereby affect the performance of the fuel pump. Accordingly, the impeller and the adjacent faces of the plate are manufactured to close tolerances to provide a desired clearance between them.

SUMMARY OF THE INVENTION

A fuel pump has an electric motor with a stator, a rotor, a generally cylindrical tube having opposed ends, a fuel pumping element driven by the electric motor to take in fuel and discharge fuel under pressure, and a plate having a face adjacent to the pumping element and a support surface against which one end of the tube is received. At least one of the support surface and the end of the tube received against the support surface is discontinuous so that the tube is not supported on the support surface along the entire circumference of the end of the tube. This preferably minimizes distortion of the plate face under loading from the tube in assembly of the fuel pump.

In one form, cavities are formed in the pump plate and these cavities interrupt the support surface. Lands may be defined between adjacent cavities, and these lands collectively define the support surface. Desirably, the support surface may flex under uneven loading by the tube such as that caused by distortion or misalignment at the end of the tube that bears on the pump plate. Flexing of the support surface can help to minimize distortions of the plate face adjacent to the pumping element. In another form, the end of the tube that is received against the support surface is discontinuous or non-planar.

Some objects, features and advantages of the present invention include providing a fuel pump that accommodates variation in a tube, maintains a desired gap between a pumping element and a pump plate, reduces friction and leakage between the pump plate and pumping element, reduces wear on various pumping element components, has an increased useful life, and is of relatively simple design and economical manufacture and assembly. Of course, other objects, features and advantages will be apparent in view of this disclosure to those skilled in the art. Fuel pumps, pump plates and/or tubes embodying the invention may achieve more or less than the noted objects, features or advantages.

BRIEF DESCRIPTION OF THE DRAWINGS

These and other objects, features and advantages of the present invention will be apparent from the following detailed description of the preferred embodiments, appended claims and accompanying drawings in which:

DETAILED DESCRIPTION OF THE PREFERRED EMBODIMENTS

Figure 1:
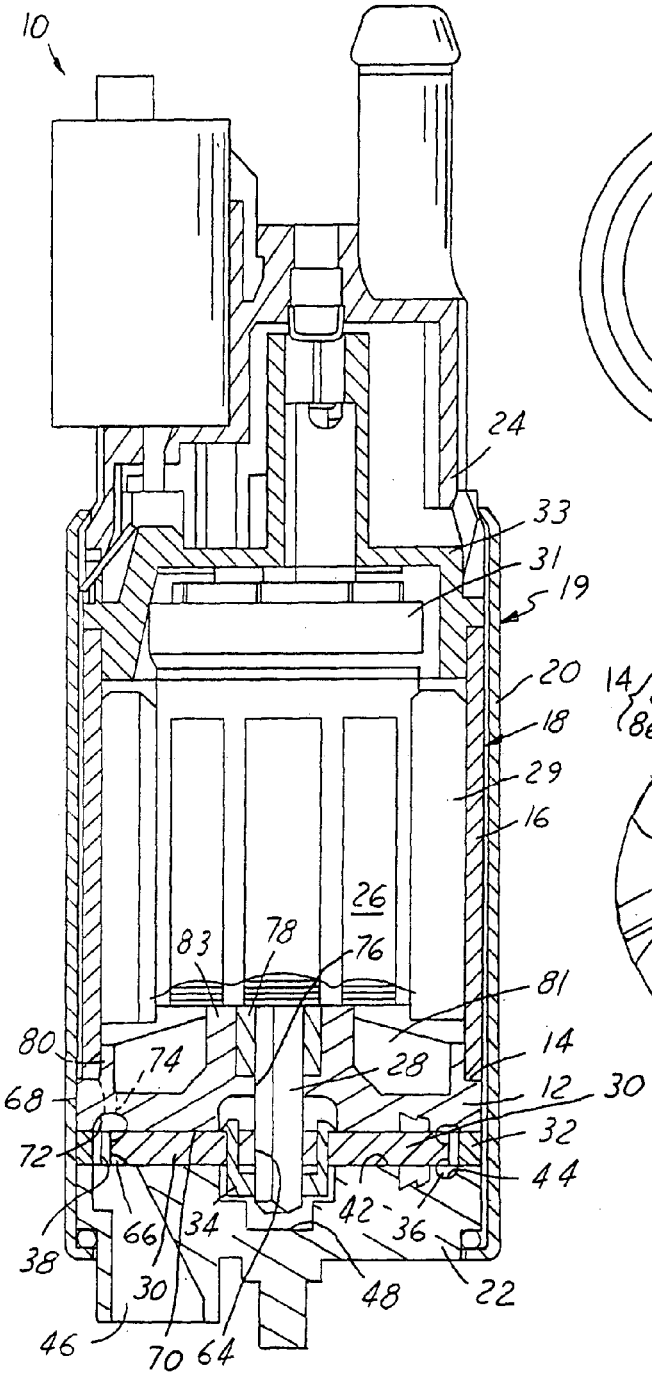
FIG. 1 is a sectional view of an electric motor fuel pump according to one embodiment of the present invention.
Figure 4:
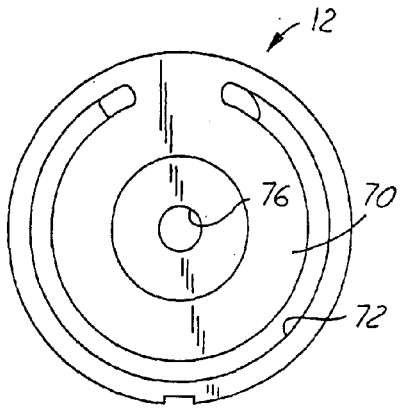
FIG. 4 is a bottom view of the pump plate.

Referring in more detail to the drawings, FIGS. 1–4 illustrate an electric motor fuel pump 10 having a pump plate 12 according to one embodiment of the present invention with a discontinuous support surface 14 for a flux tube 16 of the electric motor 18. The fuel pump 10 has a housing 19 formed by a cylindrical shell 20 that joins axially spaced inlet 22 and outlet 24 end caps. The electric motor 18 has a rotor 26 journalled by a shaft 28 for rotation within a surrounding permanent magnet stator 29 and the flux tube 16 received in the housing 19. A commutator 31 is disposed in a housing 33 adjacent to the outlet end cap 24. The embodiment shown represents a turbine-type fuel pump wherein the rotor 26 is coupled to an impeller 30 disposed between the inlet end cap 22 and the pump plate 12, and within a ring 32 encircling the impeller. The impeller 30 is coupled to the shaft 28 by a clip 34 for co-rotation with the shaft 28. An arcuate pumping channel 36 is defined about the periphery of the impeller 30 by the inlet end cap 22, pump plate 12 and the ring 32. The pumping channel 36 has an inlet port 38 into which fuel is drawn and an outlet port (not shown) through which fuel is discharged into the housing 18 under pressure. Other types or arrangements of fuel pumps can be used. For example, without limitation, the fuel pump could use a brushless electric motor, and may have a tube other than a flux tube disposed on the support surface 14.

The inlet end cap 22 has a flat upper face 42 and an arcuate groove 44 formed therein which defines in part the pumping channel 36. An inlet passage 46 through the inlet end cap 22 communicates with the inlet port of the pumping channel 36. A central blind bore 48 and counterbore provide clearance for the shaft 28 and clip 34.

The ring 32 is trapped between the inlet end cap 22 and the pump plate 12, and preferably has a predetermined thickness to control the spacing between the end cap 22 and pump plate 12. The ring 32 preferable has a centrally disposed and radially inwardly extending rib (not shown)

spanning a substantial arcuate extent of the impeller 30 between the inlet and outlet of the pumping channel.

As best shown in FIG. 1, the impeller 30 has a flat, circular body with a central hole 64 through which the shaft 28 is received, a circumferential array of angularly spaced and generally radially and axially extending vanes 66. As shown, the vanes surround the periphery of the impeller 30, but any suitable construction of vanes 66 can be employed. By way of example, without limitation, the vanes may be disposed radially inwardly of the periphery of the impeller, or may be formed adjacent only one face of the impeller. Still other vane constructions or arrangements may be employed.

The pump plate 12 is sandwiched between the flux tube 16 and the ring 32, and is preferably formed of a polymeric material. The material of the pump plate 12 is preferably resistant to degradation or swelling in liquid fuel and is sufficiently strong and durable in view of the loads applied to it in use. One presently preferred material for the pump plate 12 is polyphenylene sulfide (PPS) such as PPS 6165A6 available from Ticona, having headquarters in the United States in Summit, N.J. This material can be injection molded, is hard, strong and suitable for use in relatively high temperatures. This material has a representative tensile modulus of 19,000 MPA (using test method ISO 527), a representative compressive modulus of 18,500 MPA (using test method of ISO 605), a representative compressive strength at break of 230 MPA (using test method of ISO 604), and a representative Rockwell M-scale hardness of 100 (test method of ASTM D785). Of course, the pump plate 12 can be made from a wide range of materials including other polymers and also any suitable metal, for example without limitation, powdered metal, iron or aluminum.

The pump plate 12 preferably has a generally cylindrical sidewall 68, a substantially flat or planar lower face 70 disposed adjacent to the impeller 30 and an arcuate groove 72 formed therein defining in part the pumping channel 36. An outlet passage 74 through the body communicates the outlet port of the pumping channel 36 with the interior of the housing 19. A central through bore 76 receives the shaft 28 which preferably extends through an annular bearing 78 (FIGS. 2 and 3) disposed in the bore 76. The bearing 78 may be a separate part carried by the pump plate 12, may be formed integrally with the pump plate 12, or may be provided elsewhere, such as in or on the inlet end cap 22.

On the side of the pump plate 12 generally opposite to the lower face 70, is a generally annular, axially extending wall 80 that is disposed radially inwardly of the periphery of the pump plate 12. In the embodiments shown, the wall 80 is not circumferentially complete and terminates on opposed sides of the outlet passage 74. Of course, the outlet passage could be disposed spaced from the wall 80 and the wall could form a complete circle. For increased strength, circumferentially spaced and radially extending support ribs 81 are provided between the wall 80 and a cylindrical boss 83 that defines the bore 76. A plurality of cavities 82 are preferably provided in the pump plate 12 and lands 84 are defined between adjacent cavities 82. The lands 84 preferably have generally planar end faces 86 that collectively define the support surface 14. Preferably, a groove 88 may be formed between the wall 80 and each end face 86, to reduce the surface area of the end faces 86 and the amount of support material in the lands 84. In other words, as shown, the groove 88 separates each end face 86 and an adjacent portion of each land 84 (determined by the width and depth of the groove) from the wall 80. The groove 88 may take on any shape, and may be arranged or located other than as shown in this embodiment.

Figure 7:
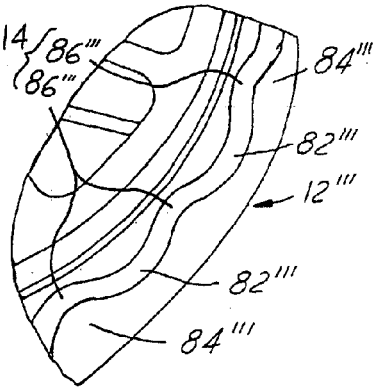
FIG. 7 is a fragmentary perspective view of yet another alternate form of a pump plate.
Figure 2:
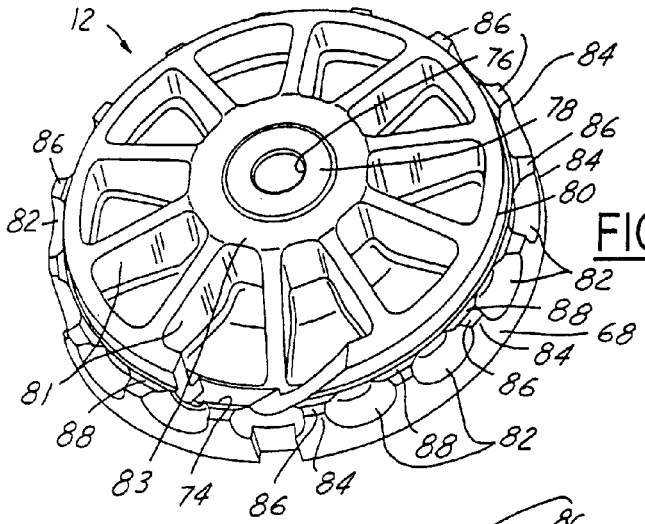
FIG. 2 is a perspective view of a pump plate of the fuel pump of FIG. 1.
Figure 3:
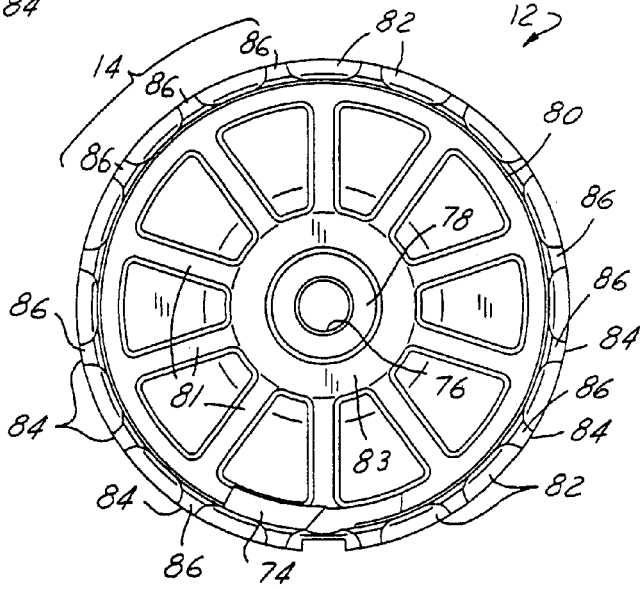
FIG. 3 is a plan view of the pump plate.
Figure 5:
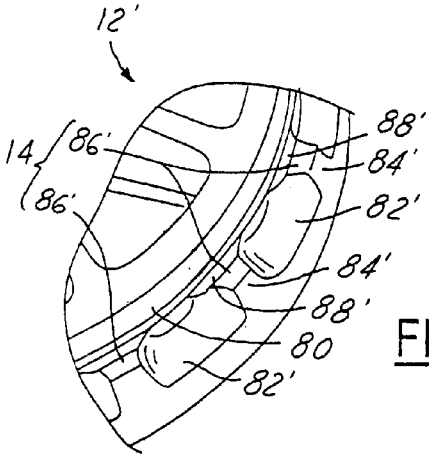
FIG. 5 is a fragmentary perspective view of an alternate form of a pump plate.
Figure 6:
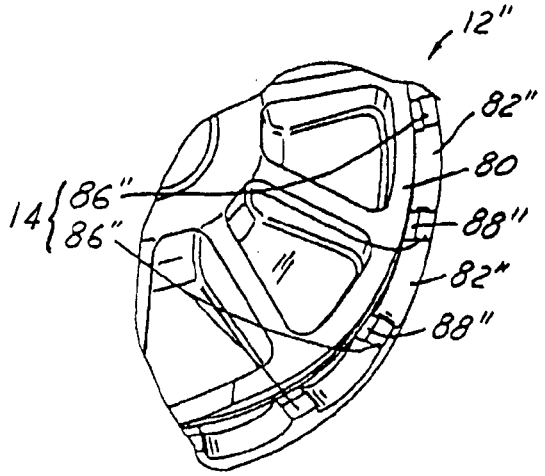
FIG. 6 is a fragmentary perspective view of another alternate form of a pump plate.

In the embodiment shown, the support surface 14 is defined radially between the periphery of the pump plate 12 and the wall 80, and is generally annular. The cavities preferably extend radially from the wall 80 into the sidewall 68 of the pump plate 12, and circumferentially between adjacent lands 84. In the embodiments shown in FIGS. 1–4, in FIG. 5, and in FIG. 6, the cavities 82, 82', 82" all have a generally concave shape. In the embodiment of the pump plate 12' shown in FIG. 5, the cavities 82' are generally concave with sloping sides adjacent the wall 80 and lands 84' defining faces 86' that collectively define the support surface 14. In the embodiment of the pump plate 12" shown in FIG. 6, the cavities 82" are generally "U-shaped" with a generally flat side adjacent to the wall 80, defining lands 84" and faces 86" that collectively define the support surface 14. Grooves 88' and 88" may also be provided as shown in FIGS. 5 and 6, respectively, like the grooves 88 in the preferred embodiment. As yet another example, again without limitation, FIG. 7 illustrates a pump plate 12''' having cavities 82''' defining a generally wave-like peripheral surface. The support surface 14 is defined by the collective faces 86''' of the peaks or lands 84''', generally the highest area of each wave, on which a tube rests in assembly. But any suitable shape or arrangement of the cavities can be utilized, the invention is not limited by the particular shape or arrangement of cavities, lands or faces shown in the presently preferred embodiments.

Hence, the support surface 14 is discontinuous. While the end faces 86 of the lands 84 collectively define a generally planar surface, the cavities 82 interrupt that surface, and preferably, so does a groove or grooves, such as the groove 88 between the wall 80 and the end faces 86. Desirably, when measured in the circumferential direction, the cavities 82 are between 0.1 and 10 times as large as the end faces 86, on average. Preferably, the cavities 82 are between 1 and 6 times as large as the end faces 86 on average.

The flux tube 16 is formed of metal, generally cylindrical, and received between the pump plate 12 and the commutator housing 33. These components are held together tightly when opposed ends of the shell 20 are rolled over portions of the outlet end cap 24 and the inlet end cap 22 during assembly of the fuel pump 10. More specifically, the flux tube 16 has one end 90 engaged with the support surface 14 and received around the wall 80, which helps to relatively locate the flux tube 16 and pump plate 12. Because the support surface 14 is discontinuous, a discontinuous support interface is provided between the support surface 14 and the tube 16 wherein the flux tube 16 is not supported around the entire circumferential extent of its end 90. Desirably, the flux tube 16 is supported along about 10% to 90% of its circumferential extent, and preferably, the flux tube 16 is supported along 20% to 50% of its circumferential extent.

If the end 90 of the flux tube 16 is distorted or otherwise not planar, the flux tube 16 transmits an uneven axial force to the pump plate 12. This uneven axial force can tend to deform or skew the pump plate 12 which can affect the clearance between the impeller 30 and the lower face 70 of the pump plate 12. By way of example, in a current typical automotive fuel pump a typical stress at the interface of a flux tube and pump plate may be on the order of 1000 psi, and may be higher in areas of deformities or irregularities. In general, it is desirable to maintain a consistent designed clearance between the impeller 30 and the pump plate 12 to prevent, for example, undue friction or fluid leakage.

To reduce the distortion at the lower face 70 of the pump plate 12, the discontinuous support surface 14 is more flexible under load than a solid surface and permits more distortion in the area of the interface between the flux tube 16 and the pump plate 12. The discontinuous support surface 14 increases the stress in the area of the interface between the flux tube 16 and the pump plate 12, and it flexes more under unusual loads, such as those due to deformities or irregularity of the flux tube 16, to minimize the influence of flux tube distortions on the face 70 of the pump plate 12. The pump plate 12 is also more responsive to changes due to variation in temperature in operation of the fuel pump 10 to minimize distortion at the face 70 of the pump plate 12. The stress at the interface between the flux tube 16 and the support surface 14 may be more than twice what the stress would be with a solid, uninterrupted support surface. By way of example, in a current typical automotive fuel pump a typical stress at the interface of the flux tube 16 and pump plate 12 may be on the order of 2000 psi or more. The cavities 82 and grooves 88 may weaken the pump plate 12 response to other loading including forces applied to the plate 12 by the pressurized fuel in the housing 19. So the currently preferred pump plate 12 is designed to minimize distortion of the face 70 when all loads are considered.

Figure 8:
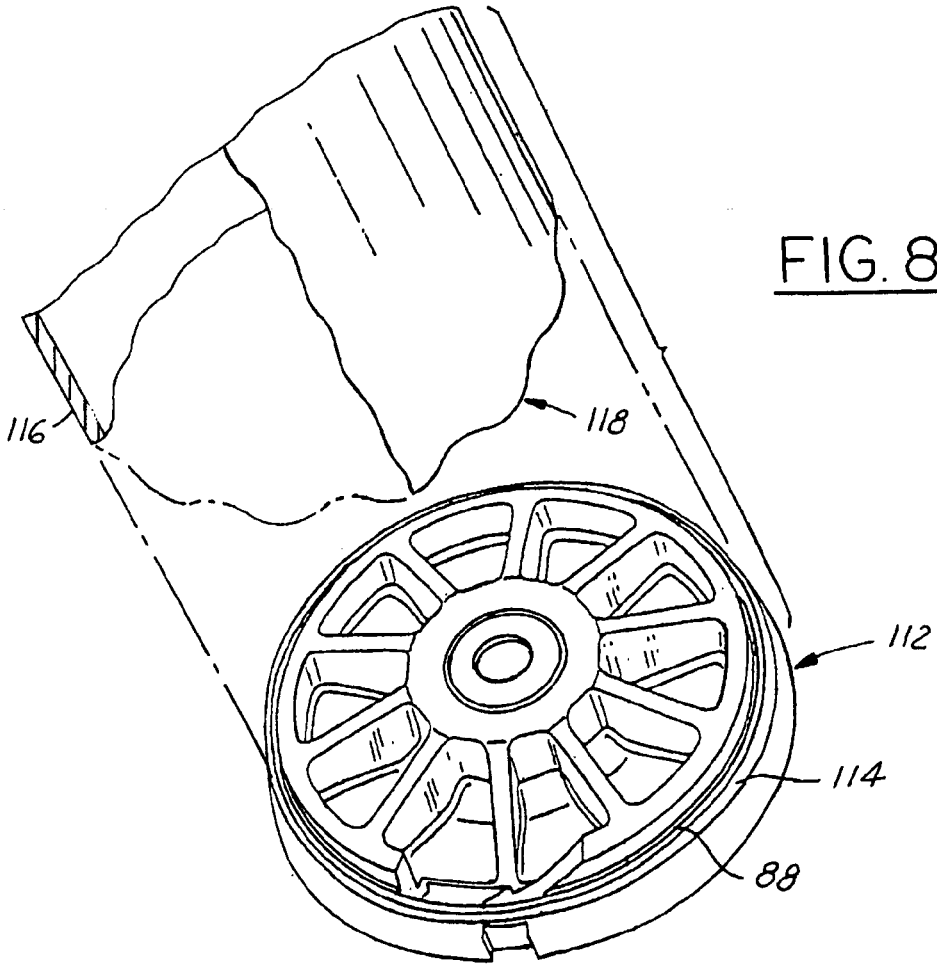
FIG. 8 is a fragmentary exploded perspective view of another embodiment of a pump plate and tube.

An alternate form of a pump plate 112 and a tube 116 are shown in FIG. 8. The tube 116 has an end 118 that is received against the pump plate 12 in assembly of a fuel pump. The end 118 of the tube 116 is non-planar or discontinuous providing a discontinuous support interface between the tube 116 and a support surface 114 of the pump plate 112. Therefore, the end 118 of the tube 116 is not supported on the support surface 114 along the entire circumference of the end 118 of the tube 116. As shown, the end 118 of the tube is generally sinuous, although other constructions and arrangements may be used. For example, without limitation, the tube 116 may have cavities or cut-outs of various size, shape, orientation and location formed in the end 118. The support surface 114 of the pump plate 112 may be generally planar, as shown in FIG. 8, or it may itself be discontinuous, if desired. A groove 88 may be formed in or adjacent to the support surface 114, as in the previous forms or embodiments. Desirably, the tube 116 engages the support surface 114 along about 10% to 90% of its circumferential extent, and preferably, the tube 116 is supported along 20% to 50% of its circumferential extent. It is also possible that an insert having at least one end that is discontinuous or non-planar may be provided between a tube 16, 116 and a support surface 14,114 to provide a discontinuous interface between the tube and support surface. In this example, both the tube and support surface may be generally planar.

Persons of ordinary skill in the art will recognize that the preceding description of the preferred embodiments of the present invention is illustrative of the present invention and not limiting. Alterations and modifications may be made to the various elements of the fuel pump generally, and to the pump plate, without departing from the spirit and scope of the present invention. For example, and without limitation, the support surface may have a different construction or arrangement, and may be interrupted in a manner different from the cavities shown in the disclosed embodiments. Also, the fuel pump and its components may be arranged differently, and the various components of the fuel pump may take may different forms. By way of example, again without limitation, the invention may be practiced with fuel pumps having brush-type or brushless electric motors, or other arrangement having a tube end loaded on a pump plate. In that regard, the tube need not be a flux tube as described with reference to the brush-type electric motor fuel pump shown in FIG. 1 herein. Still other modifications are possible within the spirit and scope of the present invention.

What is claimed is:

1. A fuel pump, comprising:

an electric motor having a stator, a rotor, and a generally cylindrical tube having opposed ends;

a fuel pumping element driven by the electric motor to take in fuel and discharge fuel under pressure; and a plate having a face disposed adjacent to the fuel pumping element and a support surface adjacent to which one end of the tube is received, and a discontinuous support interface is defined between the support surface and said one end of the tube having a plurality of circumferentially spaced apart discontinuities so that the tube is intermittently supported by the support surface along the circumference of said one end of the tube.

2. The fuel pump of claim 1 wherein the face of the plate is substantially planar.

3. The fuel pump of claim 1 wherein the pumping element is an impeller and has at least one planar side, and the face of the plate is substantially planar and disposed adjacent to a planar side of the impeller.

4. The fuel pump of claim 1 wherein at least one of the support surface and said one end of the tube is discontinuous providing the discontinuous support interface.

5. The fuel pump of claim 1 wherein said one end of the tube is supported along 10% to 90% of its circumferential extent.

6. The fuel pump of claim 5 wherein said one end of the tube is supported along 20% to 50% of its circumferential extent.

7. The fuel pump of claim 1 wherein the end of the tube received against the support surface is non-planar so that the tube engages the support surface along less than the entire circumference of that end of the tube.

8. The fuel pump of claim 7 wherein the support surface is generally planar.

9. The fuel pump of claim 7 wherein the end of the tube is generally sinuous.

10. The fuel pump of claim 7 which also comprises a groove formed in the plate reducing the surface area of the support surface of the plate.

11. The fuel pump of claim 1 wherein the plate is of a polymeric material.

12. A fuel pump, comprising:

an electric motor having a stator, a rotor, and a generally cylindrical tube having opposed ends;

a fuel pumping element driven by the electric motor to take in fuel and discharge fuel under pressure;

a plate having a face disposed adjacent to the fuel pumping element and a support surface adjacent to which one end of the tube is received, and a discontinuous support interface is defined between the support surface and said one end of the tube so that the tube is not supported by the support surface along the entire circumference of said one end of the tube; and at least two circumferentially spaced cavities adjacent to the support surface defining lands between adjacent cavities, and wherein the support surface is defined by the lands.

13. The fuel pump of claim 12 wherein the lands have a generally planar end face, and the end faces of each land collectively define the support surface.

14. The fuel pump of claim 13 wherein, when measured in the circumferential direction, the cavities are between 1 and 6 times as large as the end faces on average.

15. The fuel pump of claim 13 wherein, when measured in the circumferential direction, the cavities are between 2 and 4 times as large as the end faces on average.

16. The fuel pump of claim 13 which also comprises a groove formed adjacent to each end face further reducing the surface area of each end face.

17. The fuel pump of claim 12 wherein the cavities are generally concave along their circumferential extent.

18. A plate for a fuel pump having an electric motor with a cylindrical tube and a pumping element driven for rotation by the electric motor, comprising:

a plate body having a generally planar first side constructed to be disposed adjacent to a pumping element, a second side spaced from the first face, an annular support surface adjacent to the second side having a plurality of circumferentially spaced apart discontinuities constructed and arranged to receive and support one end of the tube so that said one end of the tube is intermittently supported and not supported along its entire circumferential extent.

19. The fuel pump plate of claim 18 which also comprises an annular wall adjacent to the second side and the support surface and adapted to be received at least in part within the tube to locate and align the plate body and tube.

20. A plate for a fuel pump having an electric motor with a cylindrical tube and a pumping element driven for rotation by the electric motor, comprising:

a plate body having a generally planar first side constructed to be disposed adjacent to a pumping element, a second side spaced from the first side, an annular support surface adjacent to the second side that is discontinuous and constructed and arranged to receive and support one end of the tube so that said one end of the tube is not supported alone its entire circumferential extent; and at least two circumferentially spaced cavities adjacent to the support surface defining lands between adjacent cavities, and wherein the support surface is defined by the lands.

21. The fuel pump of claim 20 wherein, when measured in the circumferential direction, the cavities are between 1 and 6 times as large as the lands.

22. The fuel pump of claim 21, wherein when measured in the circumferential direction, the cavities are between 2 and 4 times as large as the lands.

23. The fuel pump of claim 20 wherein the lands have end faces that each define in part the support surface, and the surface area of the support surface is reduced by between 10% to 90% compared to the surface area the support surface would have without any cavities.

24. The fuel pump of claim 23 which also comprises a groove formed adjacent to the end faces further reducing the surface area of the end faces.

25. The fuel pump of claim 20 wherein said one end of the tube is supported along 10% to 90% of its circumferential extent.

26. The fuel pump of claim 25 wherein said one end of the tube is supported along 20% to 50% of its circumferential extent.

27. A fuel pump, comprising:

an electric motor having a stator, a rotor, and a generally cylindrical tube having opposed ends;

a fuel pumping element driven by the electric motor to take in fuel and discharge fuel under pressure;

a plate having a face disposed adjacent to the fuel pumping element and a support surface against which one end of the tube is received; and one of the support or the one end of the tube having a plurality of discontinuities which are circumferentially spaced apart so that the plate is intermittently supported on the end of the tube.

28. The fuel pump of claim 27 which also comprises:

a housing in which the electric motor and pumping element are received at least in part, the housing having an inlet through which fuel is received and an outlet through which fuel is discharged;

a shaft operably associated with the rotor for co-rotation with the rotor;

the plate being received in the housing and having the support surface adjacent to one side against which one end of the tube is received; and the pumping element being received in the housing between the inlet and the plate and operably associated with the shaft so that the pumping element is driven for rotation by the electric motor to increase the pressure of fuel received in the inlet and discharge it under pressure for delivery from the outlet.

29. The fuel pump of claim 27 wherein the plate is of a polymeric material.

* * * * *